US011454915B2

(12) United States Patent
Uemura

(10) Patent No.: US 11,454,915 B2
(45) Date of Patent: Sep. 27, 2022

(54) IMAGE FORMING APPARATUS INCLUDING DEVELOPMENT CURRENT DETECTION CIRCUIT

(71) Applicant: KYOCERA Document Solutions Inc., Osaka (JP)

(72) Inventor: Shizuya Uemura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/204,871

(22) Filed: Mar. 17, 2021

(65) Prior Publication Data

US 2021/0302898 A1 Sep. 30, 2021

(30) Foreign Application Priority Data

Mar. 24, 2020 (JP) ..... JP2020-052743

(51) Int. Cl.
*G03G 15/00* (2006.01)

(52) U.S. Cl.
CPC ..... *G03G 15/80* (2013.01)

(58) Field of Classification Search
USPC ..... 399/88
See application file for complete search history.

(56) References Cited

U.S. PATENT DOCUMENTS 7,257,338 B2 8/2007 Yoshida
2004/0071477 A1* 4/2004 Do ..... G03G 15/065 399/53
2005/0158064 A1 7/2005 Yoshida

FOREIGN PATENT DOCUMENTS

JP 2005-208147 A 8/2005
JP 2006106057 A * 4/2006

* cited by examiner

*Primary Examiner* — Quana Grainger
(74) *Attorney, Agent, or Firm* — Studebaker & Brackett PC

(57) ABSTRACT

An image forming device includes a photosensitive drum, a development roller, a current detection circuit, a power supply part and a power supply control part. The development roller develops an electrostatic latent image formed on the photosensitive drum and forms a toner image on the photosensitive drum. The current detection circuit detects a development current flowing between the photosensitive drum and the development roller when the toner image is formed and outputs a detection signal showing a current value of the development current. The power supply part applies a voltage on the development roller. The power supply control part controls the power supply part such that a variation of the voltage has a negative correlation with a variation of the current value shown in the detection signal.

5 Claims, 5 Drawing Sheets

IMAGE FORMING APPARATUS INCLUDING DEVELOPMENT CURRENT DETECTION CIRCUIT

INCORPORATION BY REFERENCE

This application is based on and claims the benefit of priority from Japanese patent application No. 2020-052743 filed on Mar. 24, 2020, which is incorporated by reference in its entirety.

BACKGROUND

The present disclosure relates to an image forming apparatus.

In an image forming apparatus which forms an image on a sheet using a toner, it is generally needed to form the image having a constant density. The image forming apparatus sometimes includes a photosensitive drum, a development roller, a development current sensor, and a CPU (a central processing unit). The development current sensor detects a current value of a development current flowing between the charged photosensitive drum and the development roller to which a development bias (a voltage) is applied for a predetermined time of period. The CPU calculates a charging amount per unit mass of the toner based on the detected value of the development current sensor. Then, the CPU adjusts the development bias applied to the development roller such that a ratio of the charging amount per unit mass of the toner to a development current to be flowed when the toner image having a target image density is developed is constant, and makes the image density constant.

For example, owing to a variation (a tolerance) in shape of at least one of the photosensitive drum and the development roller, a distance between the rotating photosensitive drum and the rotating development roller may vary periodically. When the development bias and the charging bias are constant, a value of the development current varies dependent on the distance between the photosensitive drum and the development roller. That is, even when a constant development bias is applied to the development roller and a constant charging bias is applied to the photosensitive drum, a value of the development current varies depending on the distance between the photosensitive drum and the development roller. The varying of the development current corresponds to a variation in an amount of the toner supplied from the development roller to the photosensitive drum. However, in the above image forming apparatus, because a variation in shape of at least one of the photosensitive drum and the development roller is not considered, it is difficult to keep the development current constant. As a result, an amount of the toner supplied to the photosensitive drum from the development roller may vary, and there is a possibility that a density of the image formed on the sheet varies.

SUMMARY

In accordance with a first aspect of the present disclosure, an image forming device includes a photosensitive drum, a development roller, a current detection circuit, a power supply part and a power supply control part. The development roller develops an electrostatic latent image formed on the photosensitive drum and forms a toner image on the photosensitive drum. The current detection circuit detects a development current flowing between the photosensitive drum and the development roller when the toner image is formed and outputs a detection signal showing a current value of the development current. The power supply part applies a voltage on the development roller. The power supply control part controls the power supply part such that a variation of the voltage has a negative correlation with a variation of the current value shown in the detection signal.

In accordance with a second aspect of the present disclosure, an image forming device includes a photosensitive drum, a charging part, a development roller, a current detection circuit, a power supply part and a power supply control part. The charging part charges the photosensitive drum. The development roller develops an electrostatic latent image formed on the photosensitive drum and forms a toner image on the photosensitive drum. The current detection circuit detects a development current flowing between the photosensitive drum and the development roller when the toner image is formed and outputs a detection signal showing a current value of the development current. The power supply part applies a voltage on the charging part. The power supply control part controls the power supply part such that a variation of the voltage has a negative correlation with a variation of the current value shown in the detection signal.

The objects, features, and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
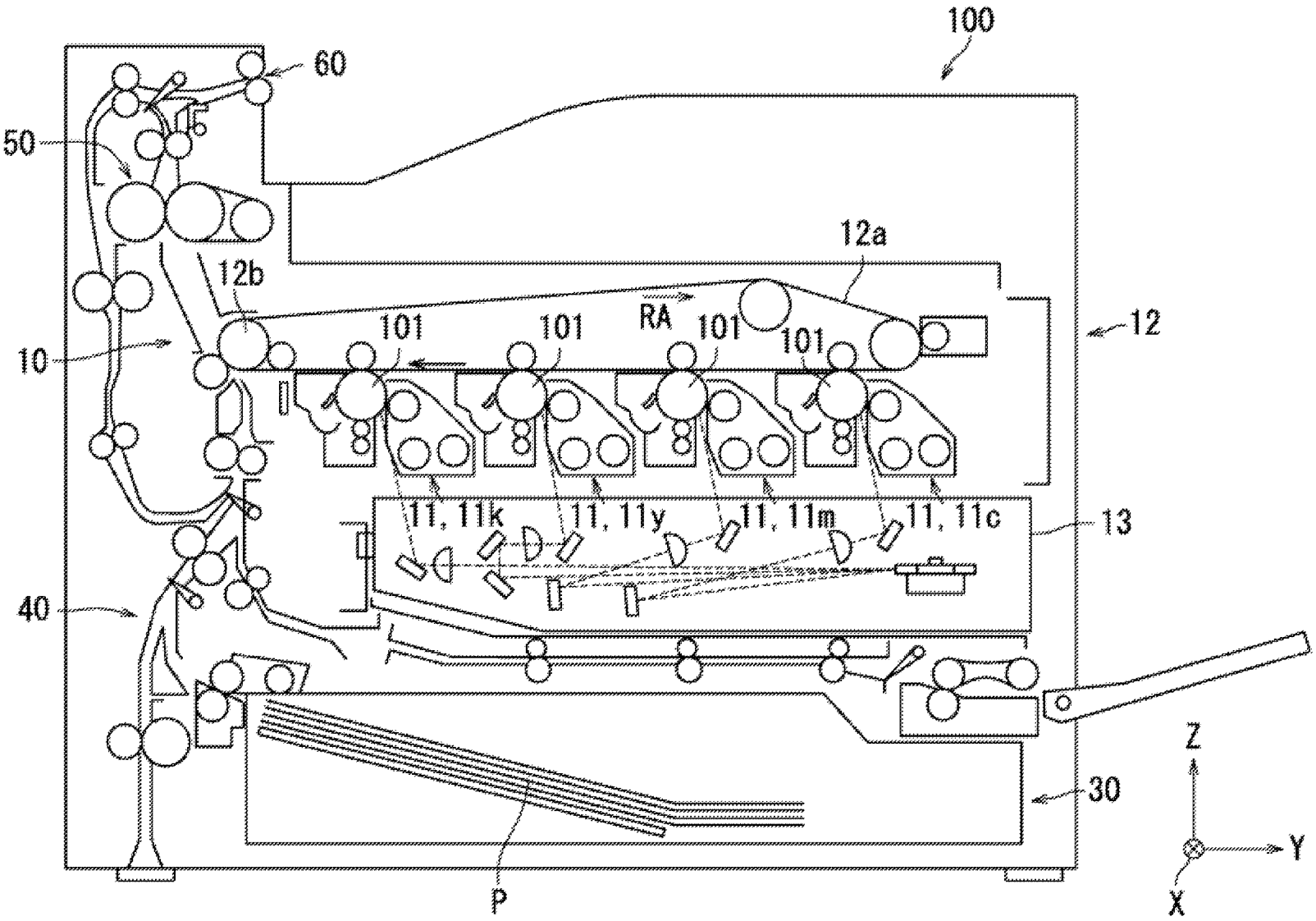
FIG. 1 is a view showing a structure of an image forming apparatus according to one embodiment of the present disclosure.

Hereinafter, with reference to the attached drawings, one embodiment of the present disclosure will be described. In the drawings, the same or corresponding portions are marked with the same reference numerals, and the description will not be repeated. In the embodiment, the X and Y axes are along the horizontal direction, the Z axis is along the vertical direction, and the X, Y, and Z axes are orthogonal to each other.

First, with reference to FIG. 1, a structure of an image forming apparatus 100 according to the embodiment will be described. FIG. 1 is a view showing the structure of the image forming apparatus 100. The image forming apparatus 100 is a color multifunctional peripheral, for example.

As shown in FIG. 1, the image forming apparatus 100 includes an image forming unit 10, a sheet feeding part 30, a conveyance part 40, a fixing part 50 and a discharge part 60.

The sheet feeding part 30 feeds a sheet P to the conveyance part 40. The conveyance part 40 conveys the sheet P to the discharge part 60 through the image forming unit 10 and the fixing part 50. The image forming unit 10 forms an image on the sheet P. The fixing part 50 heats and presses the sheet P to fix the image formed on the sheet P to the sheet P. The discharge part 60 discharges the sheet P to an outside of the image forming apparatus 100.

Next, with reference to FIG. 1, a structure of the image forming unit 10 will be described. The image forming unit 10 includes a plurality of image forming parts 11, an exposure part 13 and a transferring part 12.

To the image forming parts 11, toners of different colors are supplied. The toner contains a large number of toners. Each of the image forming parts 11 includes a photosensitive drum 101. For example, the image forming parts 11 include the image forming part 11*c* to which the cyan toner is supplied, the image forming part 11*m* to which the magenta toner is supplied, the image forming part 11*y* to which the yellow toner is supplied, and the image forming part 11*k* to which the black toner is supplied. The image forming part 11*c*, the image forming part 11*m*, the image forming part 11*y* and the image forming part 11*k* have almost the same structure.

The exposure part 13 exposes the surfaces of the photosensitive drums 101. Specifically, the exposure part 13 emits light on each photosensitive drum 101 based on an image data. As a result, an electrostatic latent image is formed on the surface of each photosensitive drum 101. The exposure part 13 includes a light source, a polygon mirror, a reflection mirror, and a deflection mirror, for example.

Then, each image forming part 11 develops the electrostatic latent image formed on each photosensitive drum 101 and forms a toner image on each photosensitive drum 101. As a result, the toner images having the different colors are formed on the photosensitive drums 101.

The transferring part 12 includes an intermediate transferring belt 12*a* and a drive roller 12*b*. The intermediate transferring belt 12*a* is driven by the drive roller 12*b* to be rotated in a rotational direction RA. The image forming parts 11 transfer the toner images having the different colors on the intermediate transferring belt 12*a*. By overlapping the toner images having the different colors on the intermediate transferring belt 12*a*, a toner image (specifically, a color toner image) is formed on the intermediate transferring belt 12*a*. The transferring part 12 transfers the toner image formed on the intermediate transferring belt 12*a* to the sheet P. As a result, the image is formed on the sheet P.

Figure 2:
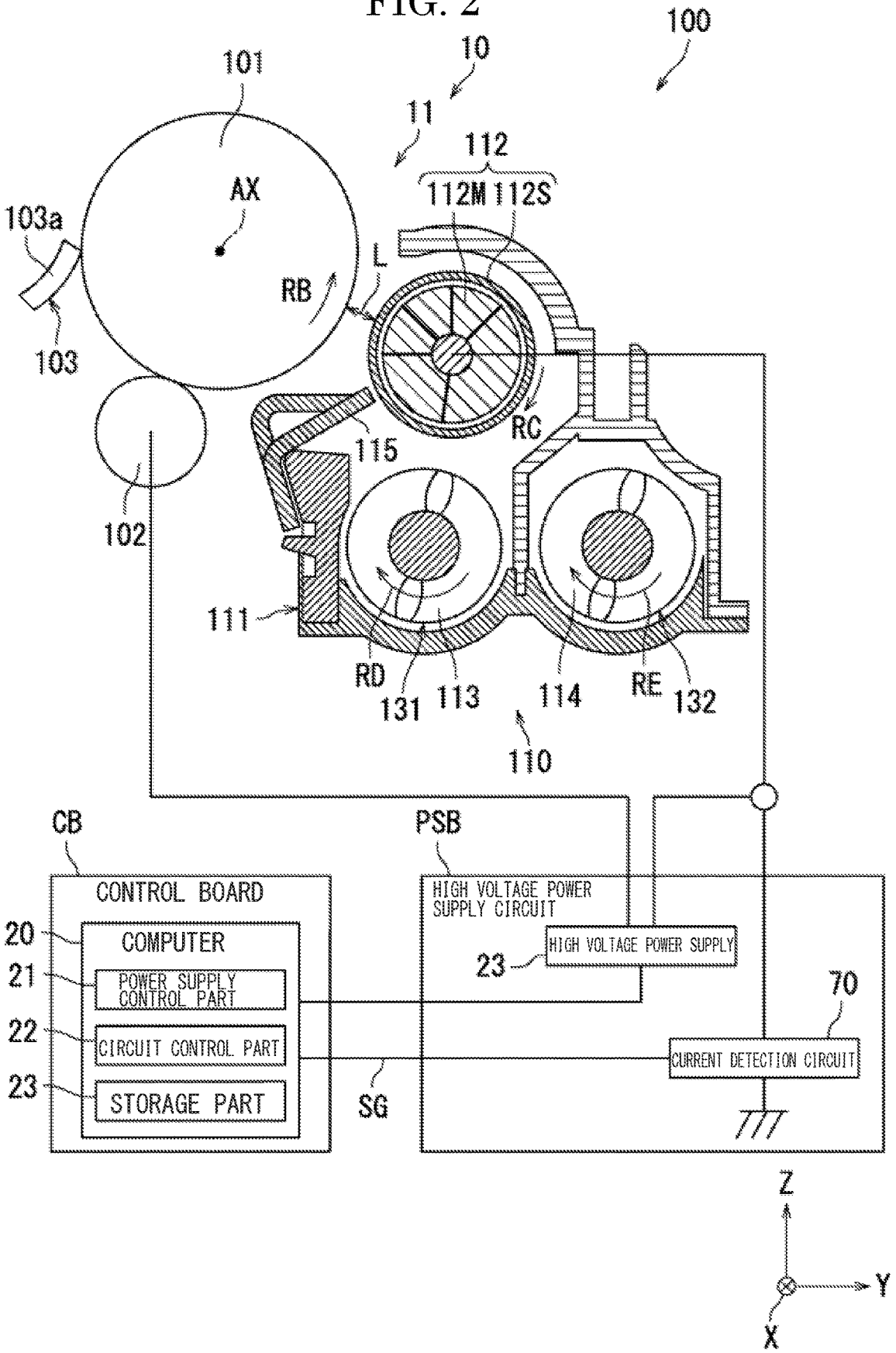
FIG. 2 is a sectional view showing one example of a structure of an image forming part according to the embodiment of the present disclosure.

Next, with reference to FIG. 1 and FIG. 2, a structure of the image forming part 11 according to the embodiment will be described. FIG. 2 is a sectional view showing one example of the structure of the image forming part 11.

As shown in FIG. 2, the image forming part 11 further includes a cleaning part 103, a development device 110 and a charging part 102 in addition to the photosensitive drum 101.

The photosensitive drum 101 has almost a columnar shape or almost a cylindrical shape. The photosensitive drum 101 rotates in a rotational direction RB around a rotational axis AX of the photosensitive drum 101. The photosensitive drum 101 is an amorphas silicon (α-Si) photosensitive drum 101 or an organic photo conductor (OPC) drum 101.

The charging part 102 charges the surface of the photosensitive drum 101 at a predetermined potential. The charging part 102 includes a charging roller, for example. After the charging part 102 charges the surface of the photosensitive drum 101 at the predetermined potential, the exposure part 13 exposes a predetermined area of the surface of the photosensitive to form the electrostatic latent image on the predetermined area.

The development device 110 forms the toner image on the photosensitive drum 101 by the toner. Specifically, the development device 110 develops the electrostatic latent image formed on the rotating photosensitive drum 101 by the toner to form the toner image on the photosensitive drum 101.

The development device 110 includes a development housing 111, a development roller 112, a first screw feeder 113, a second screw feeder 114, a regulating blade 115 and a suction fan (not shown).

The development housing 111 stores a developer. In the present embodiment, the development housing 111 stores a two-component developer. The development housing 111 includes a first conveyance part 131 and a second conveyance part 132. In the first conveyance part 131, the two-component developer is conveyed in a first conveyance direction from one axial end side to the other axial end side of the development roller 112. The second conveyance part 132 is communicated with the first conveyance part 131 at both axial end portions of the development roller 112. In the second conveyance part 132, the two-component developer is conveyed in a second conveyance direction opposite to the first conveyance direction. In the present embodiment, the first conveyance direction and the second conveyance direction are along the X axis direction.

Specifically, the second conveyance part 132 includes the second screw feeder 114. The second screw feeder 114 is rotated in a rotational direction RE, and conveys the two-component developer in the second conveyance direction. The first conveyance part 131 includes the first screw feeder 113. The first screw feeder 113 is rotated in a rotational direction RD, and conveys the two-component developer in the first conveyance direction. The first screw feeder 113 supplies the two-component developer to the development roller 112 while conveying the two-component developer in the first conveyance direction.

The two-component developer contains the plurality of toners (specifically, a large numbers of toners) and a plurality of carriers (specifically, a large numbers of carriers). The toners are powder and the carriers are powder. The toner is a positive charged toner, for example. The positive charged toner is positively charged by friction with the carrier. The carrier has a magnetic property. The carrier is a resin-coated carrier, for example. A core of the resin-coated carrier is made of ferrite or magnetite, for example.

The development roller 112 carries the toner. The development roller 112 is disposed so as to face the photosensitive drum 101. The development roller 112 is disposed at an interval L from the photosensitive drum 101. The development roller 112 includes a sleeve 112*s* and a magnet 112M. The development roller 112 is rotated at a predetermined speed.

The sleeve 112S is a nonmagnetic cylinder (for example, a pipe made of aluminum). The sleeve 112S is driven by a motor to be rotated in a rotational direction RC around the magnet 112M.

The magnet 112M is disposed inside the sleeve 112S. The magnet 112M attracts the carrier with magnetic force of the magnet 112M. As a result, a magnetic brush of the carrier is formed around the surface of the sleeve 112S. The toner is carried on the surface of the carrier. That is, the toner is carried on the surface of the development roller 112 in a state where it is carried by the magnetic brush.

The regulating blade 115 is disposed at an interval with respect to the development roller 112. The regulating blade 115 regulates a length of the magnetic brush formed around the surface of the development roller 112.

The suction fan (not shown) sucks the toner floating between the photosensitive drum 101 and the development roller 112.

The cleaning part 103 removes the toner remaining on the surface of the photosensitive drum 101. The cleaning part 103 includes a cleaning blade 103*a*.

The cleaning blade 103*a* comes into contact with the surface of the photosensitive drum 101. By bringing a tip end of the cleaning blade 103*a* into contact with the surface of the photosensitive drum 101, the toner remaining on the surface of the photosensitive drum 101 is removed.

Further, the cleaning part 103 rubs the surface of the photosensitive drum 101. Specifically, the cleaning blade 103*a* of the cleaning part 103 presses a rectangular toner image formed on the surface of the photosensitive drum 101 on the surface of the photosensitive drum 101, and shifts the toner forming the toner image. As a result, the surface of the photosensitive drum 101 is rubbed.

Next, a control board CB and a high voltage power supply board RSB will be described. The control board CB includes a micro-computer 20.

The micro-computer 20 controls each component of the image forming apparatus 100, such as the image forming unit 10, the sheet feeding part 30, the conveyance part 40, the fixing part 50 and the discharge part 60. The micro-computer 20 includes a processer such as a CPU (a central processing unit) or an ASIC (an application specific integrated circuit) and a storage part 23.

The storage part 23 includes a storage device, and stores data and computer program. Specifically, the storage part 23 includes a main storage device such as a semiconductor memory and an auxiliary storage device such as a semiconductor memory and/or a hard disk drive. The storage part 23 may include a removable media. The storage part 23 stores a detection signal SG output from a current detection circuit 70, for example. The current detection circuit 70 and the detection signal SG will be described later.

The processer of the micro-computer 20 executes the computer program stored in the storage device of the storage part 23, and serves as a power supply control part 21 and a circuit control part 22. That is, the micro-computer 20 includes the power supply control part 21 and the circuit control part 22. The power supply control part 21 and the circuit control part 22 will be described later.

The high voltage power supply board PSB includes a high voltage power supply 24 and the current detection circuit 70. The high voltage power supply 24 is an example of "a power supply part".

The high voltage power supply 14 applies a voltage on the development roller 112. Specifically, the high voltage power supply 24 is controlled by the power supply control part 21 to apply a development voltage on the development roller 112. That is, the power supply control part 21 controls the high voltage power supply 24. Hereinafter, in the specification, the voltage applied to the development roller 112 by the high voltage power supply 24 is called "a development bias Vd".

Further, the high voltage power supply 24 applies a voltage on the charging part 102. Specifically, the high voltage power supply 24 is controlled by the power supply control part 21 to apply a charging bias on the charging part 102. Hereinafter, in the specification, the voltage applied on the charging part 102 by the high voltage power supply 24 is called "a charging bias VM". The high voltage power supply 24 applies the development bias Vd on the development roller 112 and applies the charging bias VM on the charging part 102 to provide a potential difference between the photosensitive drum 101 and the development roller 112.

When the potential difference between the photosensitive drum 101 and the development roller 112 becomes a predetermined value, the toner carried on the development roller 112 is electrically attracted to the photosensitive drum 101. Specifically, in the present embodiment, in a case where the potential difference between the photosensitive drum 101 and the development roller 112 is equal to the predetermined value and the charging bias VM is larger than the development bias Vd, the toner carried on the development roller 112 is electrically attracted to the photosensitive drum 101. Then, the toner flies from the development roller 112 to the electrostatic latent image of the photosensitive drum 101 and is moved from the development roller 112 to the photosensitive drum 101. As a result, the toner image is formed on the surface of the photosensitive drum 101.

In the present embodiment, the current detection circuit 70 detects a development current flowing between the photosensitive drum 101 and the development roller 112 when the toner image is formed, and outputs a detection signal SG showing a current value of the development current. Specifically, the current detection circuit 70 is controlled by the circuit control part 22 to detect the development current and to output the detection signal SG. That is, the circuit control part 22 controls the current detection circuit 70 so as to output the detection signal SG.

In the present embodiment, the current detection circuit 70 outputs a voltage proportional to an input current. In the present embodiment, a proportional constant is a negative value. That is, in the present embodiment, the current detection circuit 70 outputs a larger voltage value as a current value of the input development current is decreased. On the other hand, the current detection circuit 70 outputs a smaller voltage value as a current value of the input development current is increased. For example, the current detection circuit 70 includes a current detection resistive element, and output a voltage proportional to a current flowing through the current detection resistive element. As described above, in the present embodiment, the detection signal SG is a voltage signal which shows a current value of the development current by a voltage. The detection signal SG output from the current detection circuit 70 is sent to the power supply control part 21.

Next, with reference to FIG. 2 to FIG. 4, the development bias Vd applied by the high voltage power supply 24 controlled by the power supply control part 21 will be described.

In a case where each of the development bias Vd applied on the development roller 112 and the charging bias VM applied on the photosensitive drum 101 is constant, a value of the development current varies depending on a distance L between the photosensitive drum 101 and the development roller 112. On the other hand, due to a variation (a tolerance) of at least one of the photosensitive drum 101 and the development roller 112, the distance L between the rotating photosensitive drum 101 and the rotating development roller 112 mat vary periodically. That is, in a case where each of the development bias Vd and the charging bias VM is constant, a value of the development current flowing between the rotating photosensitive drum 101 and the rotating development roller 112 may vary periodically.

Figure 3:
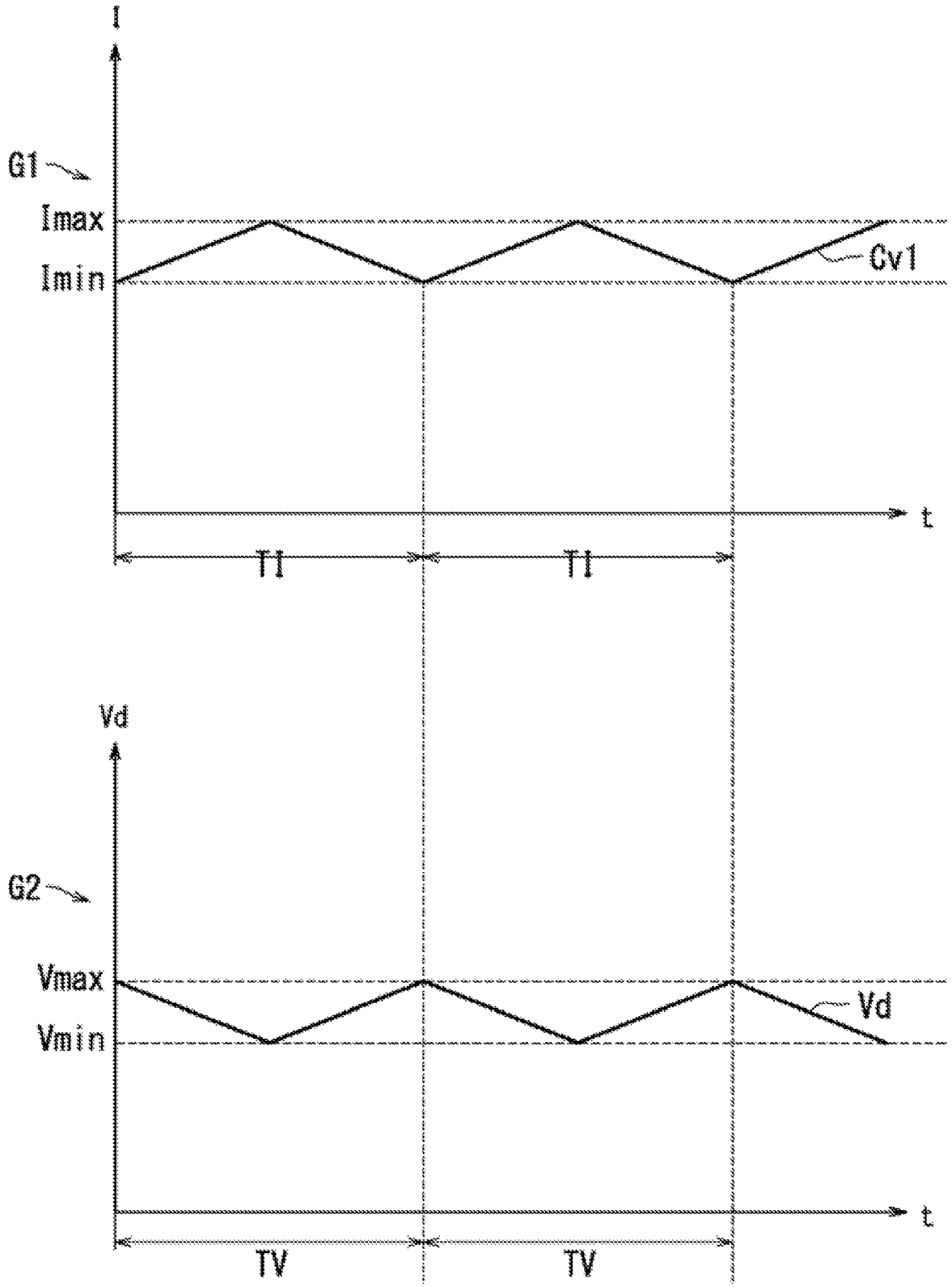
FIG. 3 is a view showing one example of a current value shown in a detection signal and a development bias having a negative correlation with a variation in the current value.

FIG. 3 is a view showing one example of a current value Cv1 shown in the detection signal SG and a development bias Vd having a negative correlation with a variation in the current value Cv1. The graph G1 shows one example of the current value Cv1 shown in the detection signal SG. In the graph G1, the horizontal axis shows a time (t) and the vertical axis shows a current value (I). In the example shown in the graph G1, each of the development bias Vd and the charging bias VM is constant.

As shown in the graph G1, the current value Cv1 varies periodically. Specifically, the current value Cv1 varies in the same manner every period T1. The period t1 corresponds to a period from a time when a starting time of a rotation period of the photosensitive drum 101 matches a starting time of a rotation period of the development roller 112 to a time when an ending time of the rotation period of the photosensitive drum 101 matches an ending time of the rotation period of the development roller 112.

In the present embodiment, when the distance L between the photosensitive drum 101 and the development roller 112 is a minimum, that is, when the photosensitive drum 101 and the development roller 112 are positioned closest to each other, the current value Cv1 shows a maximum value Imax. When the distance L between the photosensitive drum 101 and the development roller 112 is a minimum, that is, when the photosensitive drum 101 and the development roller 112 are positioned farthest from each other, the current value Cv1 shows a minimum value Imin.

The power supply control part 21 controls the high voltage power supply 24 such that a variation in the development bias Vd has a negative correlation with a variation in the current value Cv1 shown in the detection signal SG. The graph G2 shows a variation in the development bias Vd having a negative correlation with a variation in the current value Cv1 shown in the detection signal SG. In the graph G2, the horizontal axis shows a time (t) and the vertical axis shows a voltage value (V).

As shown in the graph G2, the power supply control part 21 controls the high voltage power supply 24 at almost the same period TV as the period T1 of the variation of the current value Cv1 shown in the detection signal SG. That is, the power supply control part 21 controls the high voltage power supply 24 such that the development bias Vd varies in the same manner every period TV. Therefore, the power supply control part 21 allows to control the high voltage power supply 24 to determine a variation of the development bias Vd in one period TV and to apply the development bias Vd determined every period TV repeatedly. As a result, a load of the power supply control part 21 controlling the high voltage power supply 24 is decreased.

Specifically, the power supply control part 21 calculates the period T1 of the variation of the current value Cv1 shown in the detection signal SG, based on the detection signal SG, for example. Then, the power supply control part 21 determines almost the same period TV as the calculated period T1. Further, the power supply control part 21 determines a minimum value Vmin of the development bias Vd, based on the maximum value Imax of the current value Cv1. Further, the power supply control part 21 determines a maximum value Vmax of the development bias Vd, based on the minimum value Imin of the current value Cv1. The power supply control part 21 controls the high voltage power supply 24 so as to vary the development bias Vd, based on the determined period TV, the determined minimum value Vmin and the determined maximum value Vmax.

Figure 4:
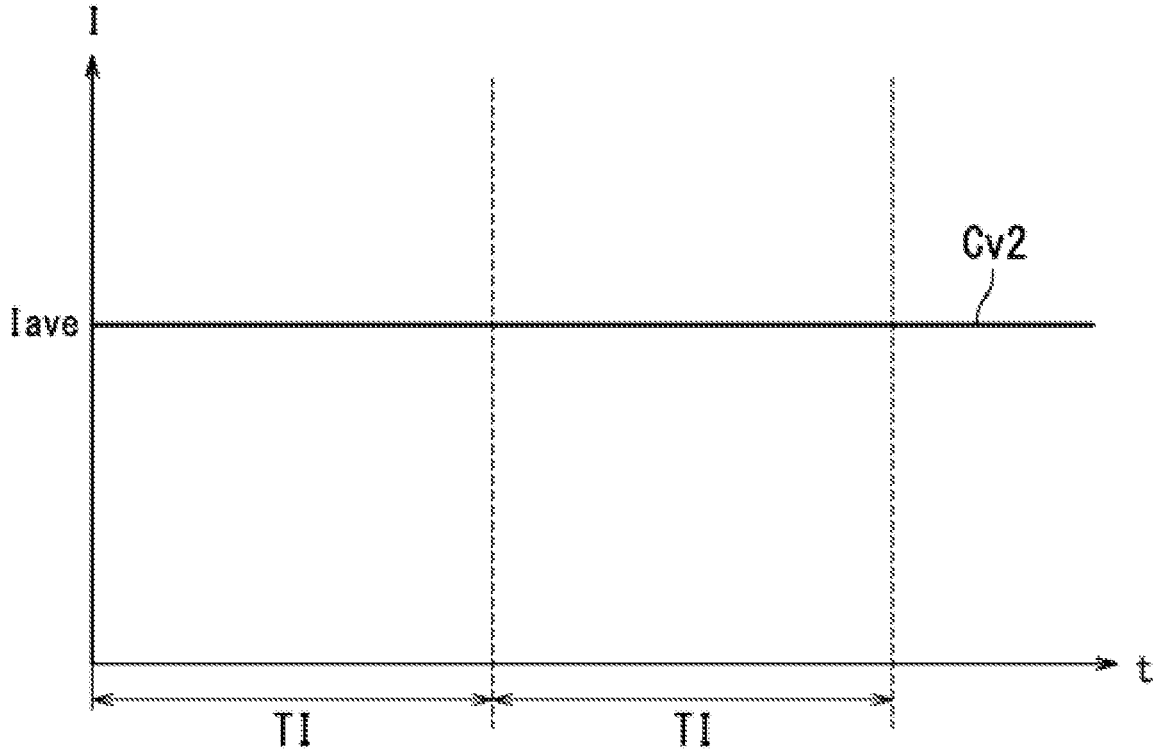
FIG. 4 is a view showing a current value of a development current when a high voltage power supply controlled by a power supply controller in the present embodiment applies a development bias.

FIG. 4 is a view showing a current value Cv2 of the development current when the high voltage power supply 24 controlled by the power supply control part 21 applies the development bias Vd. In FIG. 4, the horizontal axis shows a time (t) and the vertical axis shows a current value (I).

As shown in FIG. 4, a current value Cv2 of the development current is constant when the development bias Vd varying so as to have a negative correlation with a variation of the current value Cv1 is applied on the development roller 112. In the present embodiment, the current value Cv2 shows an average value lave of the current value Cv1 shown by the graph G1 in FIG. 3. That is, by applying the development bias Vd varying so as to have a negative correlation with a variation of the current value Cv1 on the development roller 112, a development current flowing between the photosensitive drum 101 and the development roller 112 becomes constant. That is, when the power supply control part 21 controls the high voltage power supply 24 such that a variation of the development bias Vd has a negative correlation with the variation of the current value Cv1 shown in the detection signal SG, the development current becomes constant. As a result, an amount of the toner supplied from the development roller 112 to the photosensitive drum 101 is constant so that it becomes possible to form the image having a constant density on the sheet P.

Here, at a time of an assembling of the image forming apparatus 100, the photosensitive drum 101 and the development device 110 are attached to the image forming apparatus 100. Further, the photosensitive drum 101 may be replaced depending on a state of the photosensitive drum 101. In the same manner, the development device 110 may be replaced depending on a state of the development roller 112. That is, every time when at least one of the photosensitive drum 101 and the development device 110 is attached to the image forming apparatus 100, depending on a variation (a tolerance) of at least one of the photosensitive drum 101 and the development roller 112, the periodical variation of the distance L between the rotating photosensitive drum 101 and the rotating development roller 112 may further vary. Therefore, the periodic variation in the development current flowing when each of the development current Vd and the charging bias Vm is constant may further vary. Then, in the present embodiment, the circuit control part 22 controls the current detection circuit 70 to output the detection signal SG based on the attachment of at least one of the photosensitive drum 101 and the development device 110 to the image forming apparatus 100.

The circuit control part 22 stores the detection signal SG output from the current detection circuit 70 in the storage part 23. Then, until at least one of the photosensitive drum 101 and the development device 110 is detached from the image forming apparatus 100, the power supply control part 21 controls the high voltage power supply 24 such that a variation of the development bias Vd has a negative correlation with a variation of the current value Cv1 shown in the detection signal SG stored in the storage part 23. That is, as long as the periodic variation of the development current depending on the periodic variation of the distance L continues, the power supply control part 21 controls the high voltage power supply 24 such that a variation of the development bias Vd has a negative correlation with a variation of the current value Cv1 shown in the detection signal SG stored in the storage part 23. Therefore, even when at least one of the photosensitive drum 101 and the development roller 112 is newly attached to the image forming apparatus 100, a variation of the development current can be suppressed. As a result, a certain amount of toner can be stably supplied to the photosensitive drum 101, and the density of the image formed on the sheet P is stabilized.

Figure 5:
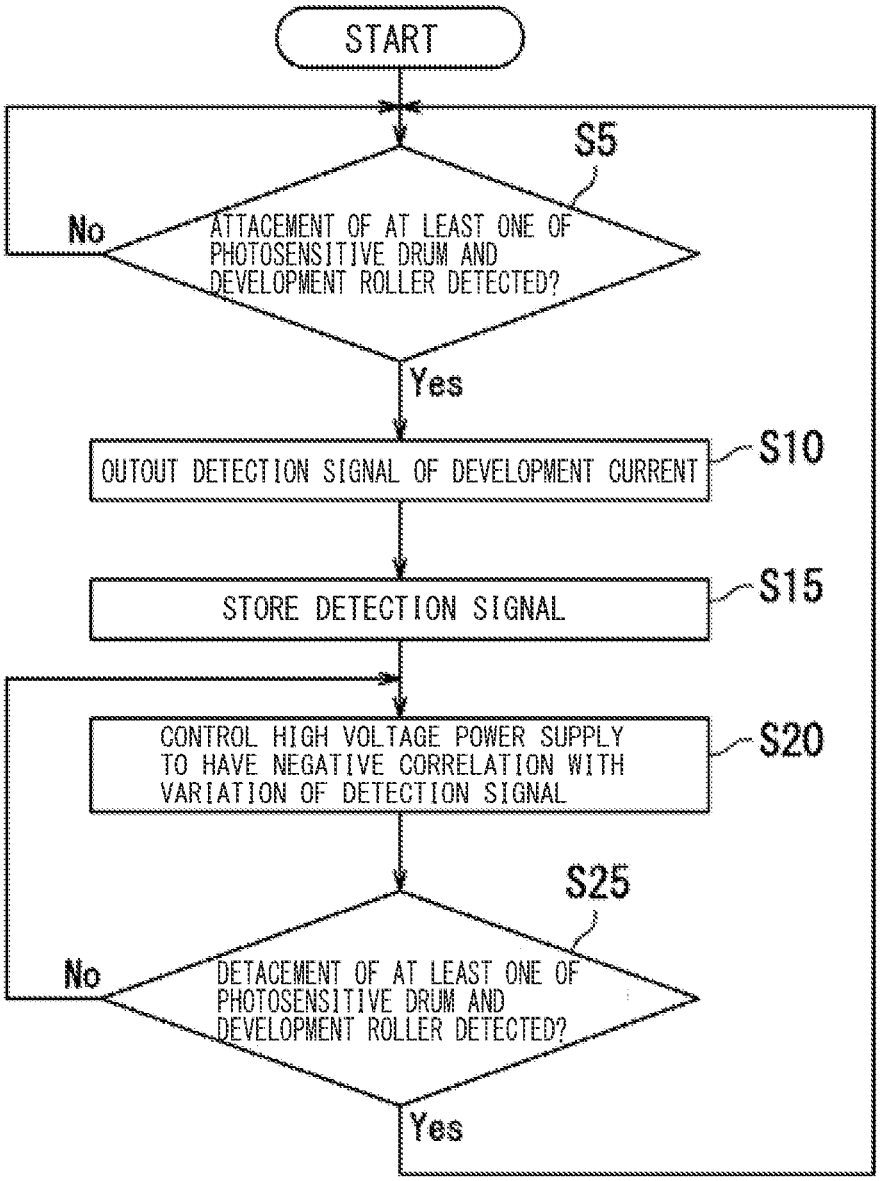
FIG. 5 is a block diagram showing a processing executed by a computer in the embodiment of the present disclosure.

Next, with reference to FIG. 5, a processing executed by the micro-computer 20 will be described. FIG. 5 is a flow chart showing the processing executed by the micro-computer 20. The processing executed by the micro-computer 20 contains steps from step S5 to step 25.

In step S5, the micro-computer 20 determines whether at least one of the development device 110 and the photosensitive drum 101 is attached to the image forming apparatus 100. When the determination is negative (No) in step S5, the processing returns to step S5. That is, until it is detected that at least one of the development device 110 and the photosensitive drum 101 is attached to the image forming apparatus 100, the micro-computer 20 waits. On the other hand, when the determination is positive (Yes) in step S5, the processing proceeds to step S10. That is, depending on the detection of an attachment of at least one of the development device 110 and the photosensitive drum 101 by the micro-computer 20, the processing proceeds to step S10.

In step S10, the circuit control part 22 controls the current detection circuit 70 to detect a development current flowing between the photosensitive drum 101 and the development roller 112 and to output a detection signal SG showing a current value of the development current. That is, the current detection circuit 70 detects the development current and then outputs the detection signal SG showing the current value of the development current.

In step S15, the circuit control part 22 causes the storage part 23 to store the detection signal SG output from the current detection circuit 70. That is, the storage part 23 stores the detection signal SG output from the current detection circuit 70.

In step 20, the power supply control part 21 controls the high voltage power supply 24 such that a variation of the development bias Vd has a negative correlation with a variation of the current value Cv1 shown in the detection signal SG stored in the storage part in step S15. That is, the high voltage power supply 24 varies the development bias Vd so as to have a negative correlation with a variation of the current value Cv1 shown in the detection signal SG stored in the storage part 23 in step S15.

In step S25, the micro-computer 20 determines whether at least one of the development device 110 and the photosensitive drum is detached from the image forming apparatus 100. When the determination is negative (No) in step S25, that is, when the development device 110 and the photosensitive drum 101 continue to be attached to the image forming apparatus 100, the processing returns to step S20. That is, when the development device 110 and the photosensitive drum 101 continue to be attached to the image forming apparatus 100, the high voltage power supply 24 varies the development bias Vd so as to have a negative correlation with a variation of the current value Cv1 shown in the detection signal SG stored in the storage part 23 in step S15.

On the other hand, when the determination is positive (Yes) in step S25, that is, when at least one of the development device 110 and the photosensitive drum 101 is detached from the image forming apparatus 100, the processing returns to step S5.

Embodiments of the present disclosure was described with reference to the drawings. However, the present disclosure is not limited to the above embodiments, and various embodiments (for example, the following embodiments) can be performed without departing from the gist thereof. Further, various disclosures can be formed by appropriately combining a plurality of components disclosed in the above embodiments. For example, some components may be removed from all components shown in the embodiments. Additionally, components over different embodiments may be combined as appropriate. The drawings schematically show the respective components mainly for the sake of easy understanding, and the thickness, length, number, interval, and the like of each component shown are different from the actual ones for convenience of drawing preparation. Further, the speed, material, shape, sizes, and the like of the components shown in the above embodiments are only examples, and are not particularly limited, and various changes can be made without substantially departing from the structure of the present disclosure.

(1) As described with reference to FIG. 2, according to the present embodiment, the power supply control part 21 controls the high voltage power supply 24 such that a variation of the development bias Vd has a negative correlation with a variation of the detection signal SG. However, as long as the periodic variation of the development current can be suppressed, the power supply control part 21 may control the high voltage power supply 24 such that a variation of the charging bias VN has a negative correlation with a variation of the current value Cv1 shown in the detection signal SG. Specifically, the power supply control part 21 controls the high voltage power supply 24 such that a variation of the charging bias VM applied to the charging part 102 has a negative correlation with a variation of the current value Cv1 shown in the detection signal SG.

(2) The order from step S5 to step S25 may be changed as appropriate.

The present disclosure may be used in a field of the image forming apparatus.

The invention claimed is:

1. An image forming apparatus comprising:

a photosensitive drum;

a development roller which develops an electrostatic latent image formed on the photosensitive drum and forms a toner image on the photosensitive drum;

a current detection circuit which detects a development current flowing between the photosensitive drum and the development roller when the toner image is formed and outputs a detection signal showing a current value of the development current;

a power supply part which applies a voltage on the development roller;

a power supply control part which controls the power supply part such that a variation of the voltage has a negative correlation with a variation of the current value shown in the detection signal;

a circuit control part which controls the current detection circuit to output the detection signal; and a storage part which stores the detection signal, wherein the power supply control part controls the power supply part at almost the same period as a period of a variation of the current value shown in the detection signal, the power supply control part controls the power supply part such that a variation of the voltage has a negative correlation with a variation of the current value shown by the detection signal until at least one of a development device including the development roller and the photosensitive drum is detached from the image forming apparatus, and the circuit control part controls the current detection circuit so as to output the detection signal depending on an attachment of at least one of the development device and the photosensitive drum to the image forming apparatus.

2. An image forming apparatus comprising:

a photosensitive drum;

a development roller which develops an electrostatic latent image formed on the photosensitive drum and forms a toner image on the photosensitive drum;

a current detection circuit which detects a development current flowing between the photosensitive drum and the development roller when the toner image is formed and outputs a detection signal showing a current value of the development current;

a power supply part which applies a voltage on the development roller; and a power supply control part which controls the power supply part such that a variation of the voltage has a negative correlation with a variation of the current value shown in the detection signal, wherein the power supply control part controls the power supply part at almost the same period as a period of a variation of the current value shown in the detection signal, and the period is a period from a time when a starting time of a rotational period of the photosensitive drum matches a starting time of a rotational period of the development roller to a time when an ending time of the rotational period of the photosensitive drum matches an ending time of the rotational period of the development roller.

3. An image forming device comprising:

a photosensitive drum;

a charging part which charges the photosensitive drum;

a development roller which develops an electrostatic latent image formed on the photosensitive drum and forms a toner image on the photosensitive drum;

a current detection circuit which detects a development current flowing between the photosensitive drum and the development roller when the toner image is formed and outputs a detection signal showing a current value of the development current;

a power supply part which applies a voltage on the charging part;

a power supply control part which controls the power supply part such that a variation of the voltage has a negative correlation with a variation of the current value shown in the detection signal, a circuit control part which controls the current detection circuit to output the detection signal; and a storage part which stores the detection signal, wherein the power supply control part controls the power supply part at almost the same period as a period of a variation of the current value shown in the detection signal, the power supply control part controls the power supply part such that a variation of the voltage has a negative correlation with a variation of the current value shown by the detection signal until at least one of a development device including the development roller and the photosensitive drum is detached from the image forming apparatus, and the circuit control part controls the current detection circuit so as to output the detection signal depending on an attachment of at least one of the development device and the photosensitive drum to the image forming apparatus.

4. The image forming apparatus according to claim 1, wherein the current detection circuit includes a current detection resistive element, and the detection signal is a voltage signal shown by a voltage proportional to a current flowing the current detection resistive element.

5. The image forming apparatus according to claim 1, wherein the power supply control part controls the power supply part such that the development current is constant.

* * * * *